United States Patent [19]

Brain et al.

[11] Patent Number: 4,616,467

[45] Date of Patent: Oct. 14, 1986

[54] MACHINE FOR INSERTING TABS IN CONTAINER PACKS

[76] Inventors: Michael Brain, 72 Holmwood Avenue, Leeds LS64NJ; Richard D. Wade, "Badgerstone", Langford Ride, Borley in Wharedale, Yorkshire; Brian Barker, 2 Church Lane, Corringham, Gainsborough Lincs DN215RA, all of England

[21] Appl. No.: 612,108

[22] Filed: May 18, 1984

[30] Foreign Application Priority Data

May 21, 1983 [GB] United Kingdom ..... 8314146

[51] Int. Cl.[4] ..... B65B 61/14

[52] U.S. Cl. ..... 53/134; 493/88; 493/137; 493/909

[58] Field of Search ..... 53/134, 413, 48, 128; 206/200, 165, 164, 163; 493/88, 137, 136, 390, 391, 392, 909

[56] References Cited

U.S. PATENT DOCUMENTS

| | | | |
|---|---|---|---|
| 2,543,698 | 2/1951 | Lebold | 206/200 X |
| 2,766,567 | 10/1956 | Fahrenbach et al. | 53/413 X |
| 3,202,312 | 8/1965 | Atkinson | 206/200 X |
| 3,258,152 | 6/1966 | Cameron | 206/200 X |
| 4,213,283 | 7/1980 | Calvert et al. | 53/48 |
| 4,290,254 | 9/1981 | Brunone | 53/48 X |

*Primary Examiner*—James F. Coan

[57] ABSTRACT

The invention describes a machine which folds blanks of cut and creased material to define folded tabs which have tongues. The tongues have flaps which are folded over onto the tongues and the thus held tabs are transported by a revolving drum and the tongues and flaps are inserted in an aperture or apertures of a holding device holding groups of containers together. The machine operates continuously and the drum is provided with pairs of plates the opening and closing of which are controlled by cams to enable the insertion of the folded blanks within the pairs of plates by an insertion knife which reciprocates radially of the drum.

18 Claims, 40 Drawing Figures

MACHINE FOR INSERTING TABS IN CONTAINER PACKS

This invention relates to a machine for inserting tabs in container packs. The container packs comprise an assembly of containers held together by means of a holding device, and typically such holding device may comprise a web of plastics material with container holes therein in which the containers are frictionally fitted. The holding devices may also have finger apertures through which fingers may be inserted for the lifting of the pack. One such holding device which is well known and in extensive use is known as a "HICONE" (Trade Mark) holding device, although other alternative types of holding device are now becoming available.

The tab is for insertion in the finger aperture or apertures of the holding device, and comprises a blank of cut and creased sheet material which is folded so as to present it in a suitable disposition for insertion in the device.

The concept of providing a tab of this nature is substantially novel, and there is therefore no relevant prior art as regards the present invention of which we are aware.

The present invention seeks to provide a machine which will operate in synchronism with the application of the holding device or devices to the containers to form packs, when such packs form a queue output from the holding application machine.

In accordance with the invention there is provided a machine for inserting a tab in an assembly of containers held together by a holding device which has at least one aperture comprising:

(a) means for folding in two a cut and creased blank which forms the tab;

(b) means for folding flaps of the blank onto tongues of the blank;

(c) means for inserting the tongues and folded flaps of the blank into said apertures or apertures in the holding device so that the flaps will spring outwardly and engage under the holding device connecting the tab to the assembly; and (d) means for effecting the above operations on a repeating basis so that tabs are sequentially erected and inserted in respective assemblies which travel as a queue relative to the means for inserting.

Preferably, the machine includes means for transporting the blank, after the folding steps (a) and (b), from a receiving station of the means for transporting to the inserting means.

Preferably said means for transporting comprise a rotatable drum having angularly arranged holders for respective blanks, said holders each comprising a pair of radially arranged plates.

Of each pair of plates, preferably one is a leading plate and one is a trailing plate, and the machine includes cam means controlling the relative angular positions of the leading and trailing plates of each pair during each revolution of the drum to ensure effective positioning of the folded blanks between the plate pairs by means of a reciprocal knife, which comprises said means for folding the blank in two, and which reciprocates radially with respect to said drum.

The said cam means may also serve to position the blank appropriately for insertion in the aperture or apertures of said holding device in that the machine includes conveyor means on which the assemblies travel tangentially relative to the drum, and the blanks are progressively so inserted up to the point where the assembly lines radially of the drum.

Said cam means may further comprise respective leading and trailing cam plates located at opposite ends of the drum and each leading plate is on a shaft pivotally mounted on the drum plates at a fixed radius, and has a crank carrying a follower roller which engages in and follows a cam track in the leading cam plate and each trailing plate is on a shaft mounted on said drum plates at said fixed radius and has a crank carrying a follower roller which engages in and follows the cam tracks of the trailing cam plate.

The said means for folding a flap comprises two rotatable rollers having folding wings which initially fold two flaps on two tongues out of the plane of the blank and two fixed plough devices which complete the folding of the flaps onto said tongues as the blank is folded by means for folding the blank in two.

The means for insertion preferably comprises reciprocable lever arms which are reciprocated in synchronism with the operation of the machine to push the folded blanks in a direction at right angles to the queue of assemblies.

There may be a magazine for receiving a plurality of the flat blanks, and the machine may include extraction means for extracting the blanks one by one in synchronism with the operation of the machine to place the blanks individually in operative positions for engagement by means for folding the blanks in two.

An embodiment of the present invention will now be described, by way of example, with reference to the accompanying drawings, wherein.

Figure 3A:
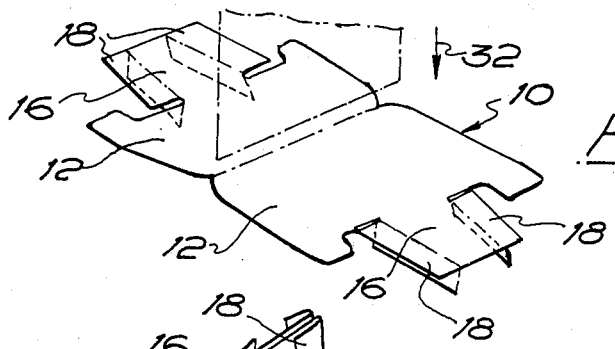
Figure 3B:
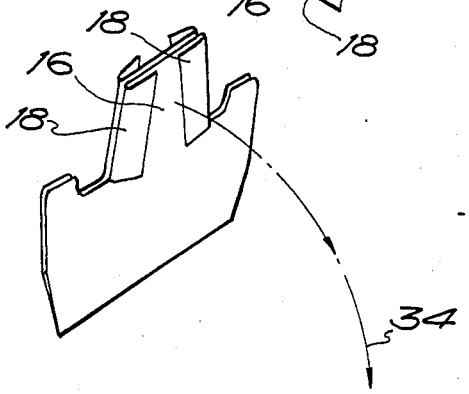
Figure 3C:
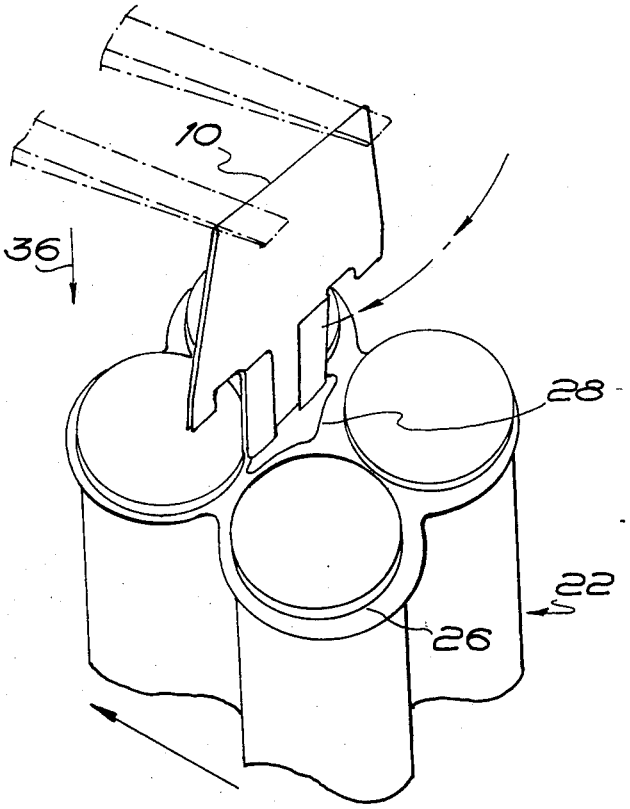
Figure 4:
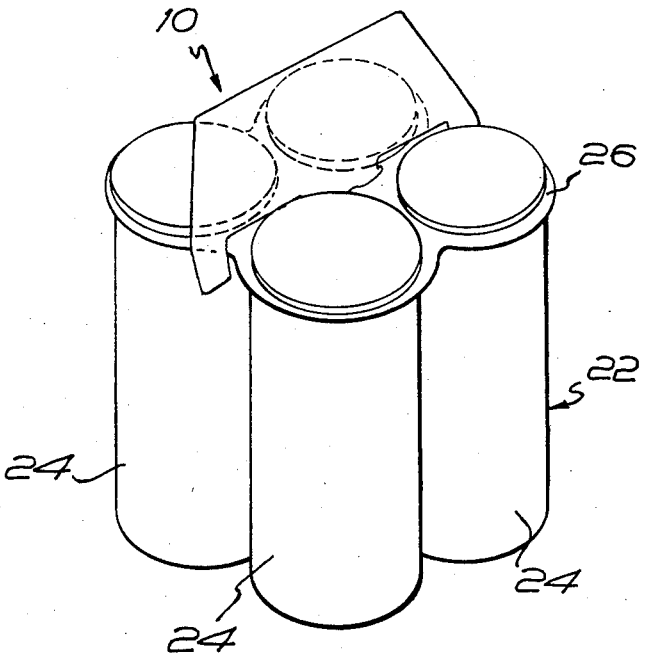
Figure 5:
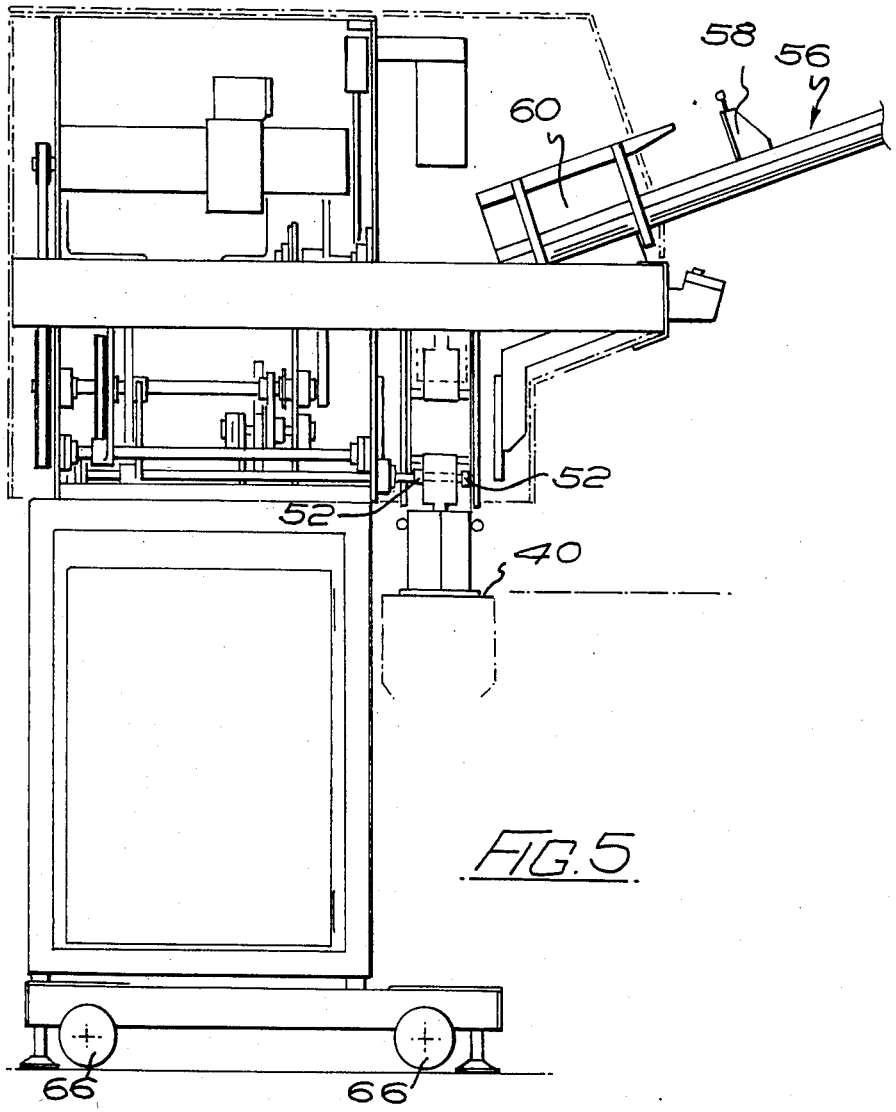
Figure 6:
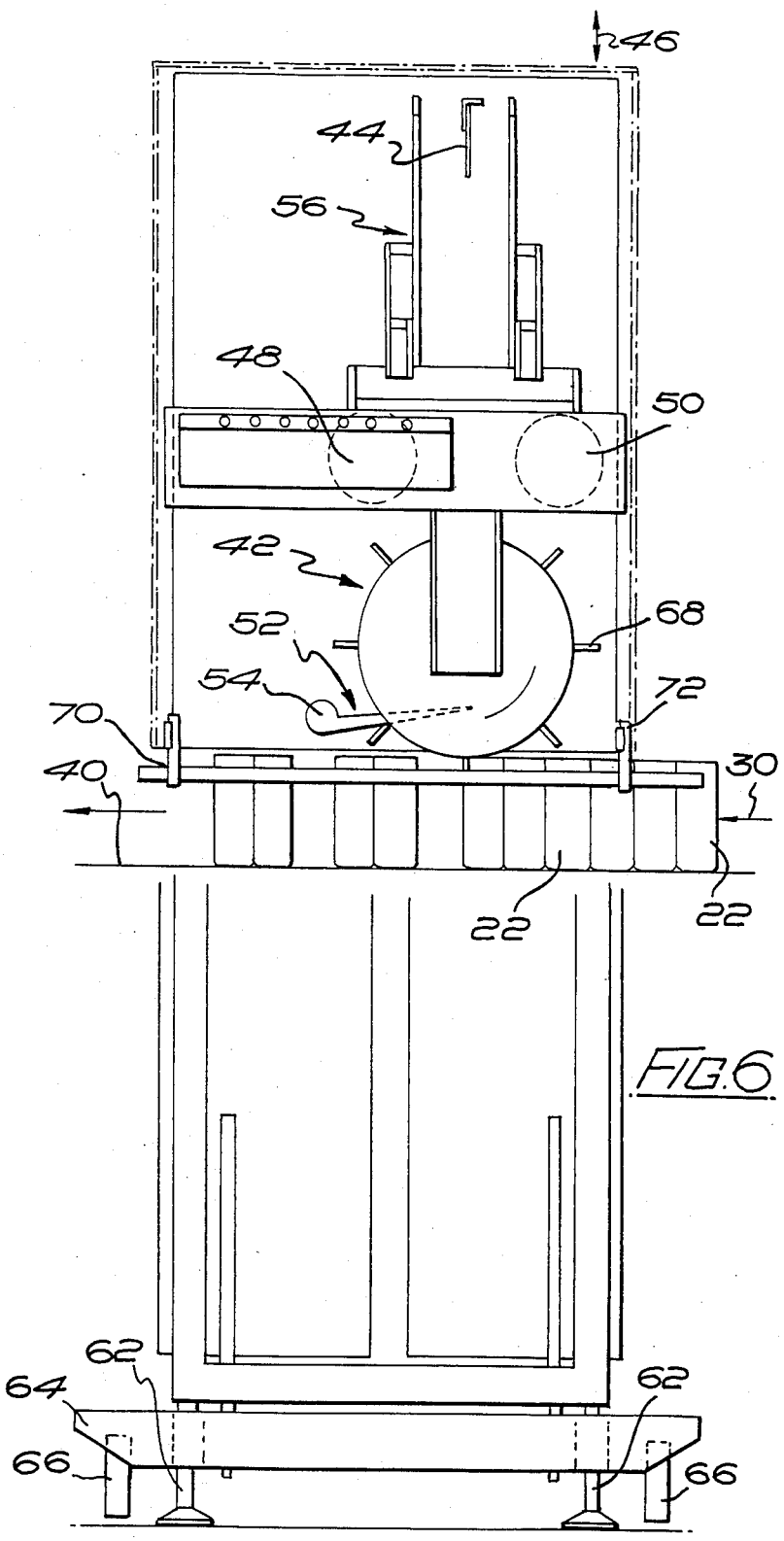
Figure 7:
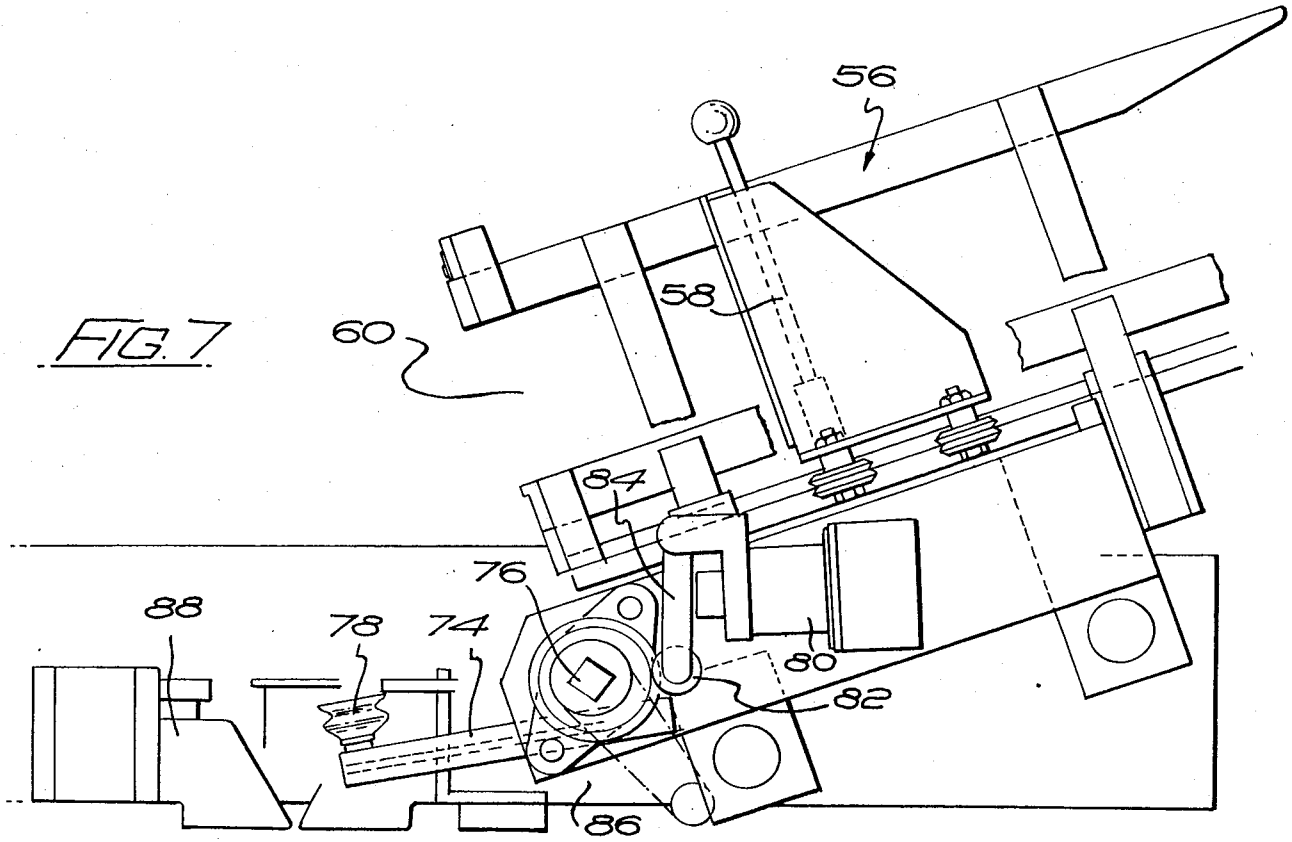
Figure 8:
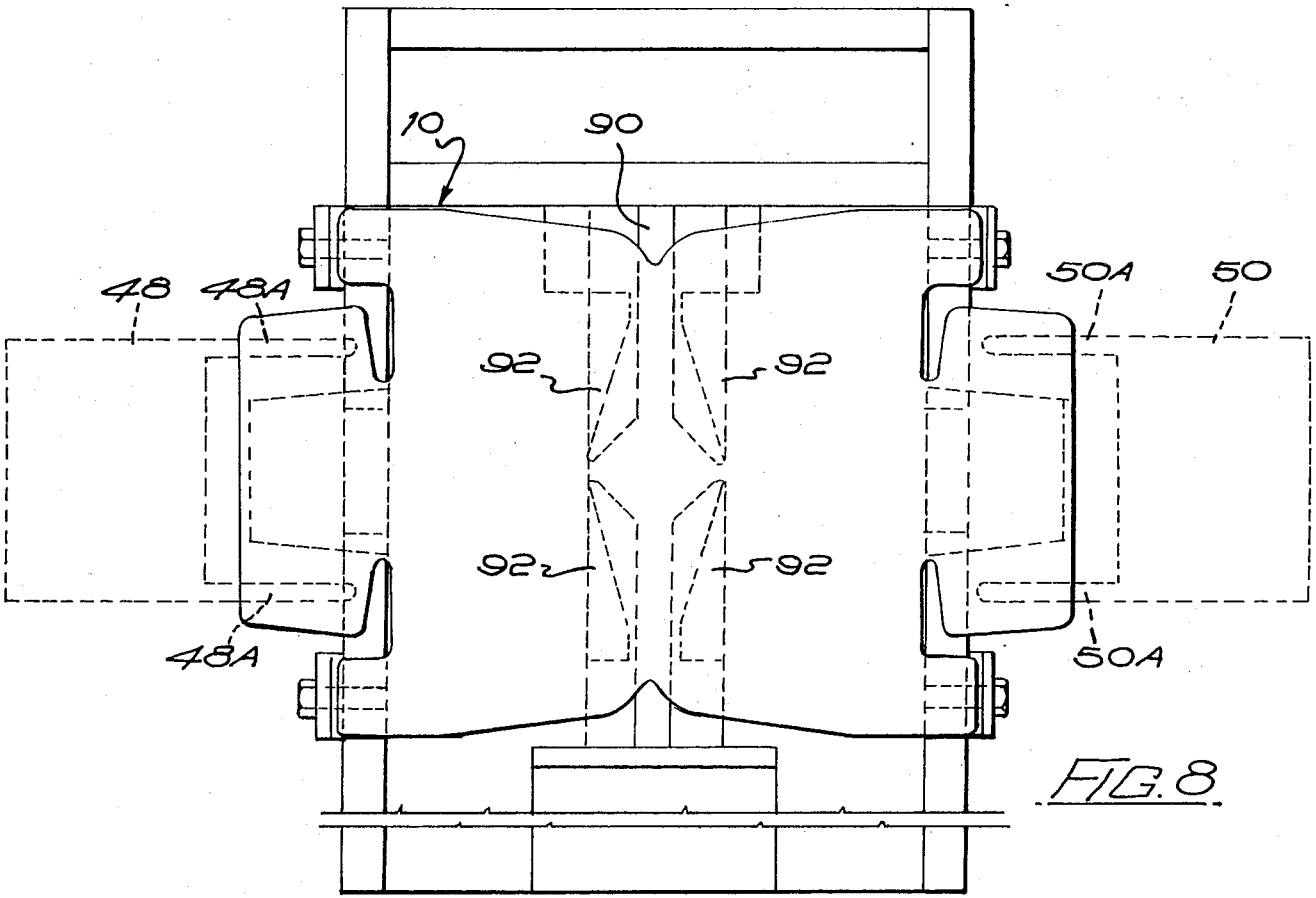
Figure 9:
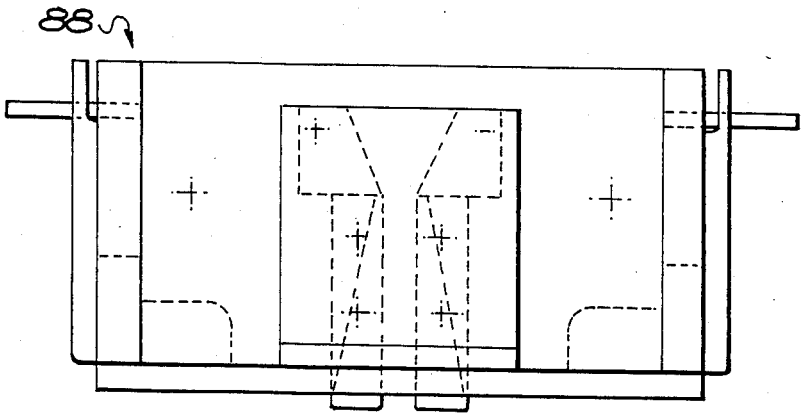
Figure 10:
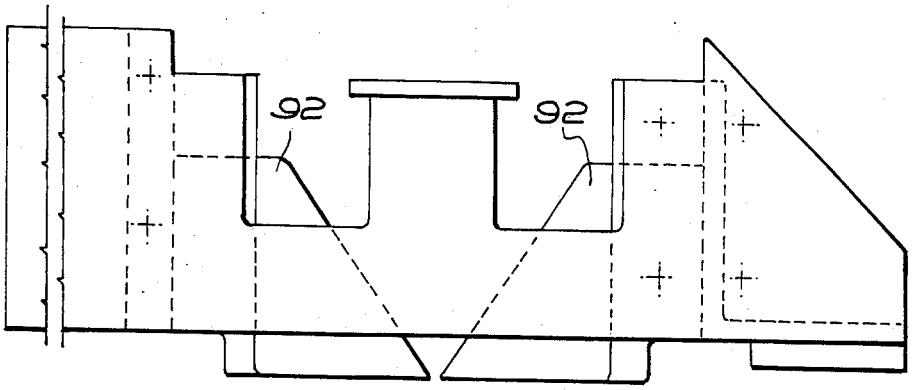
Figure 11:
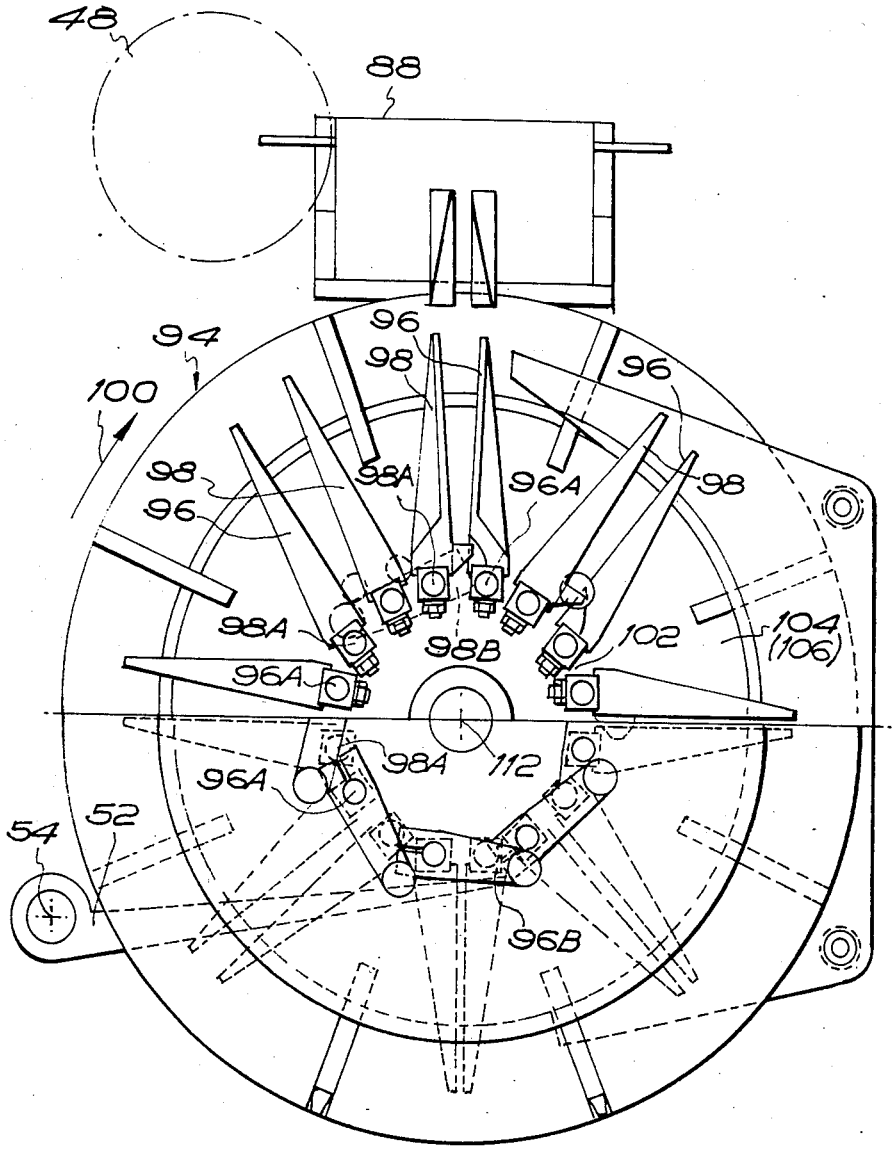
Figure 11A:
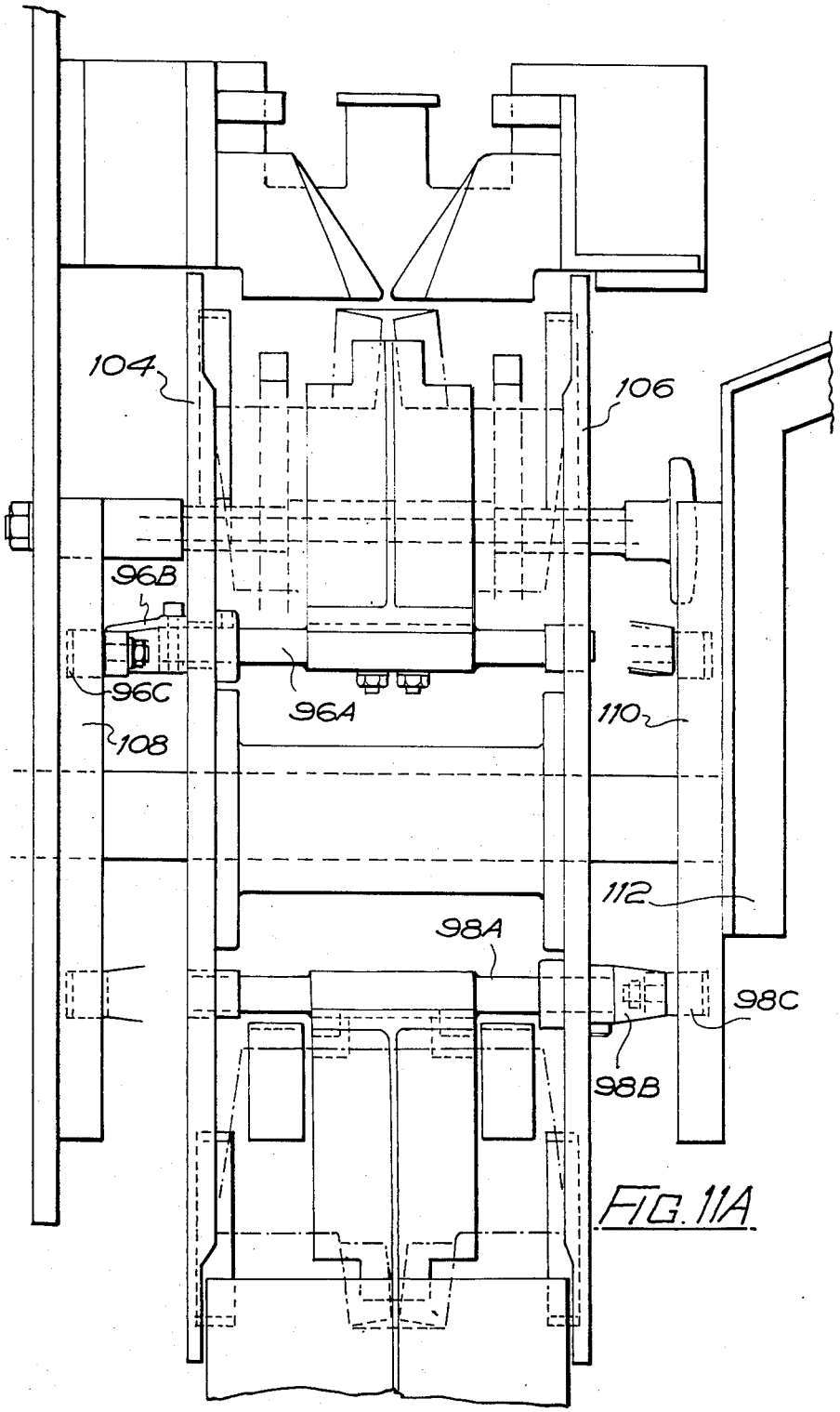
Figure 11B:
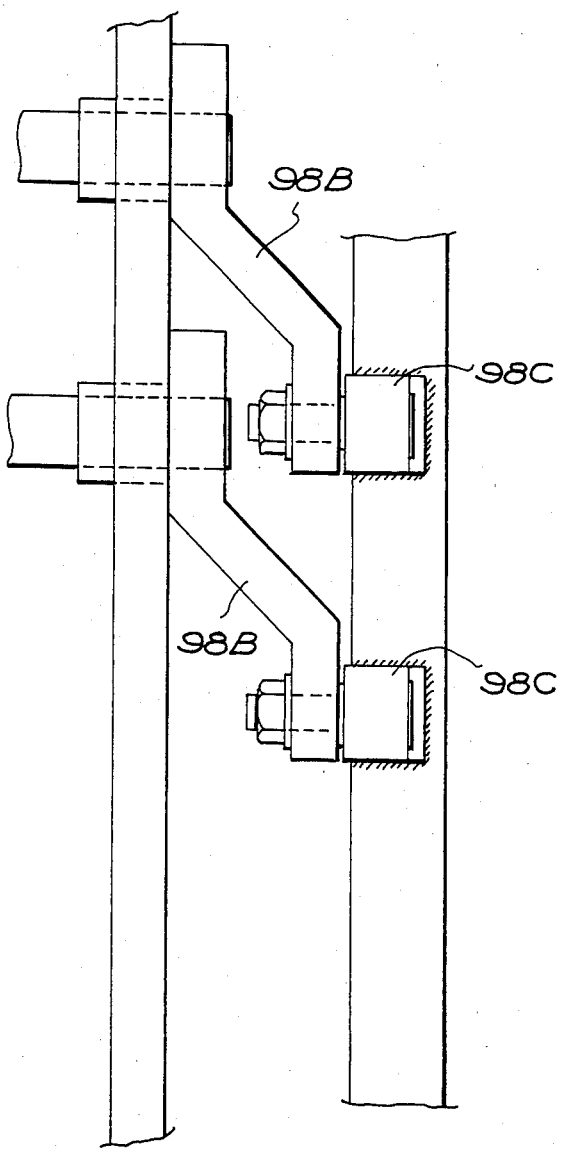
Figure 12:
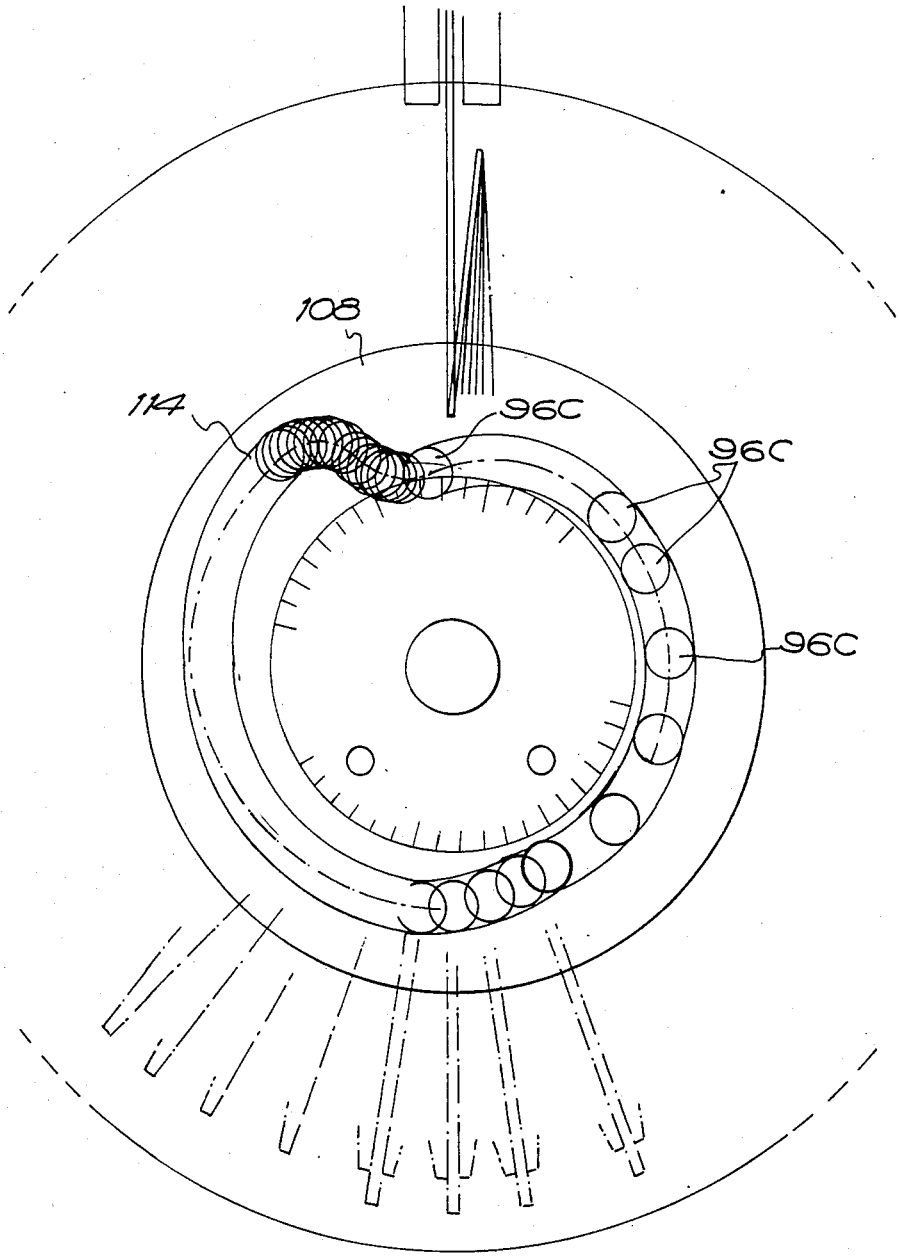
Figure 13:
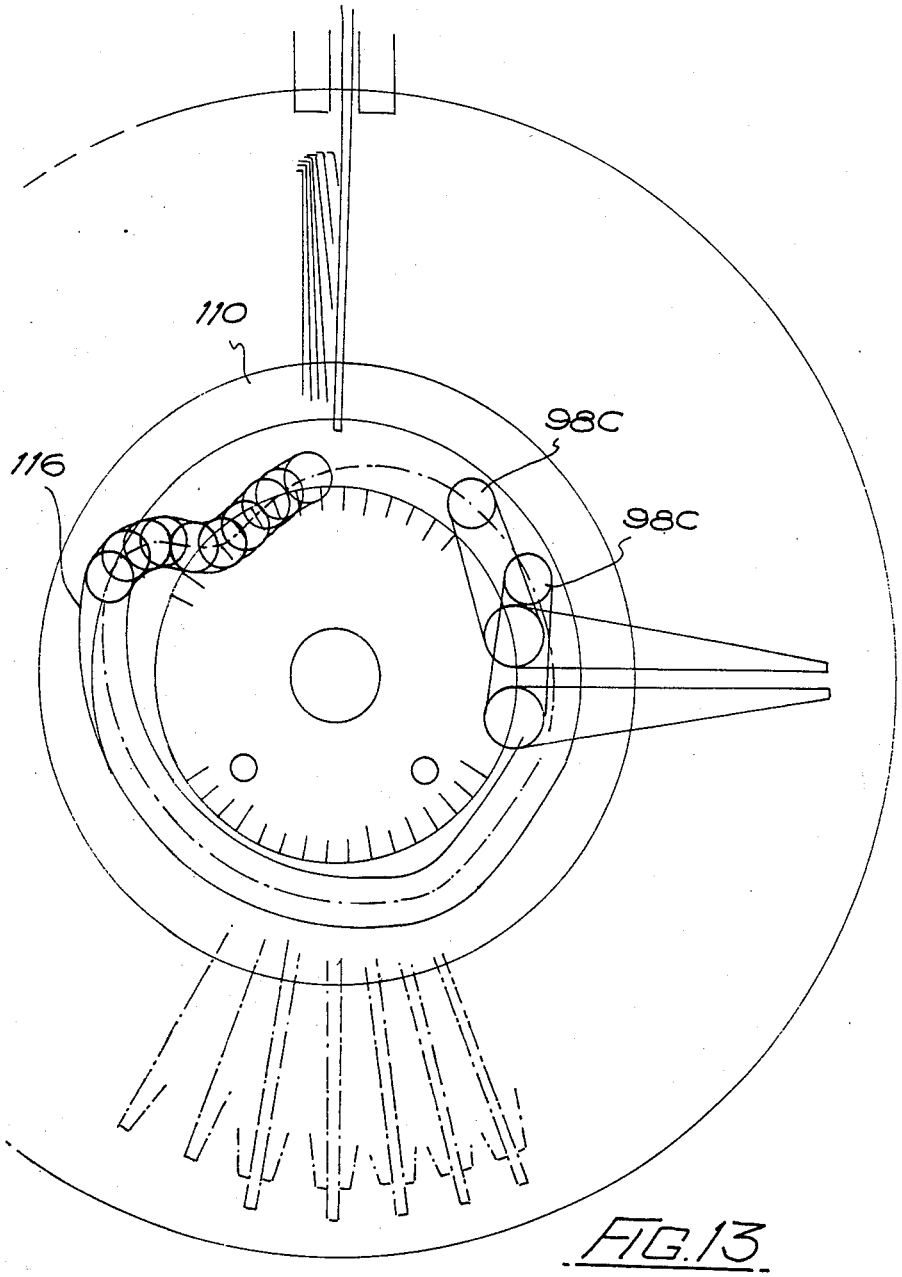
Figure 14:
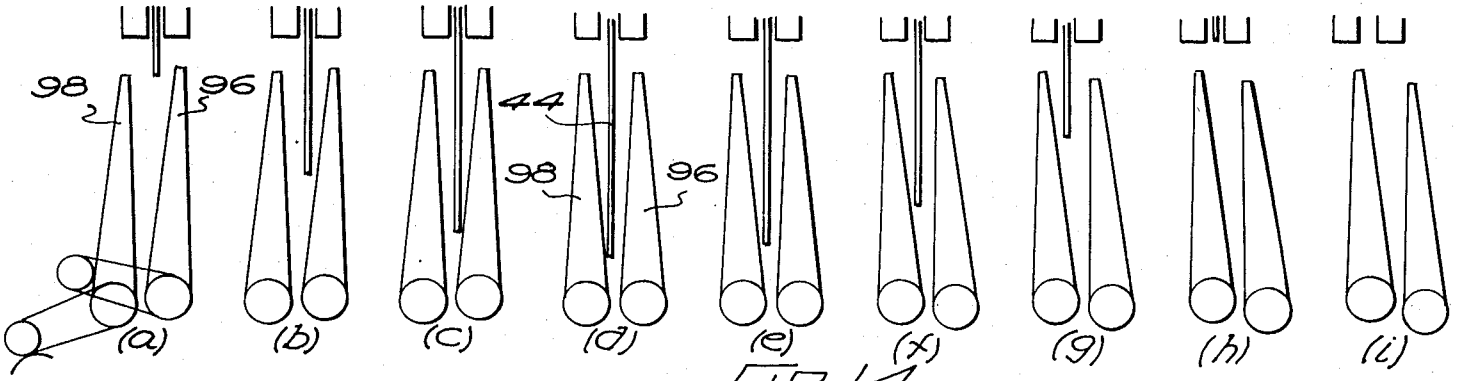
Figure 16:
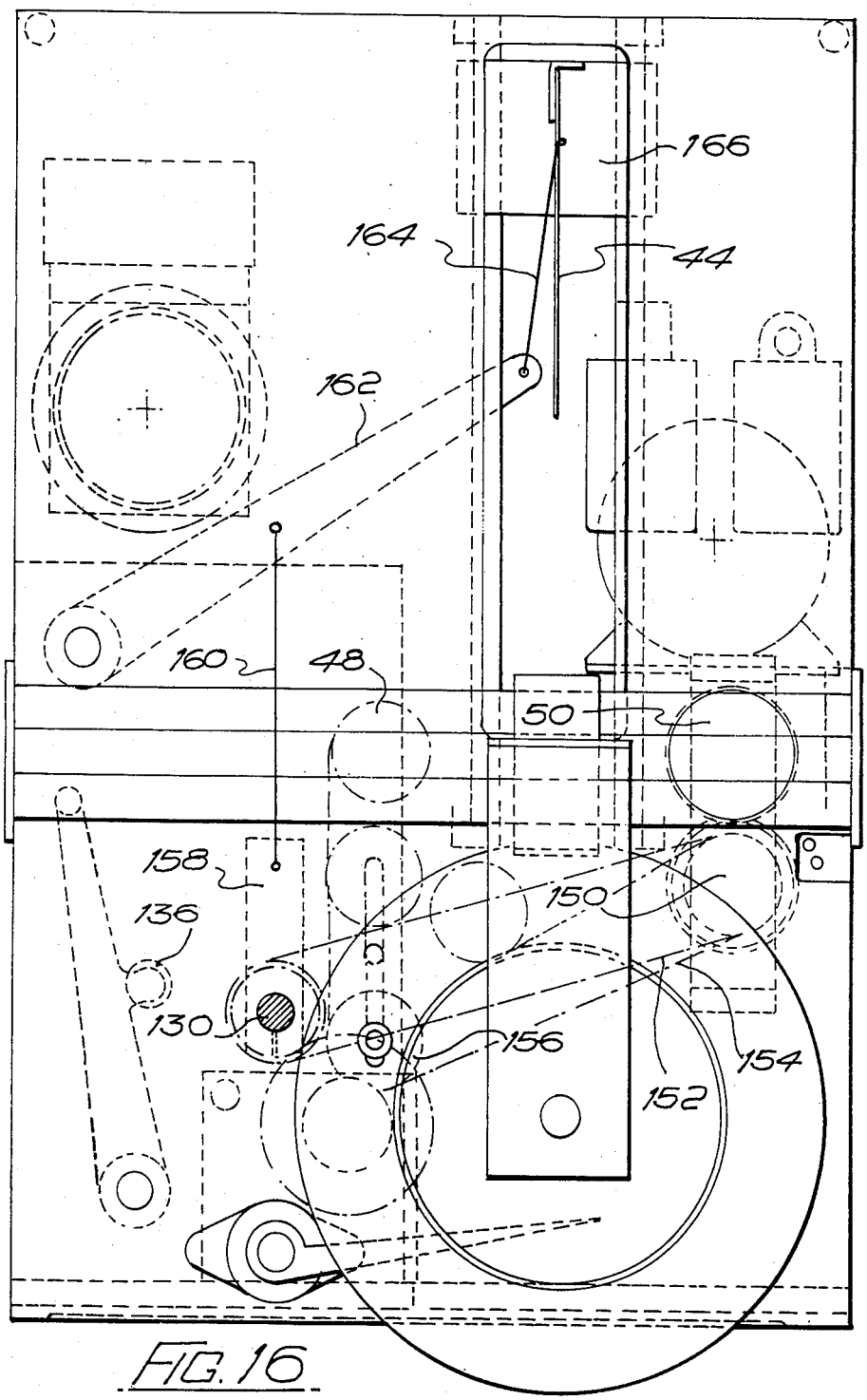
Figure 17:
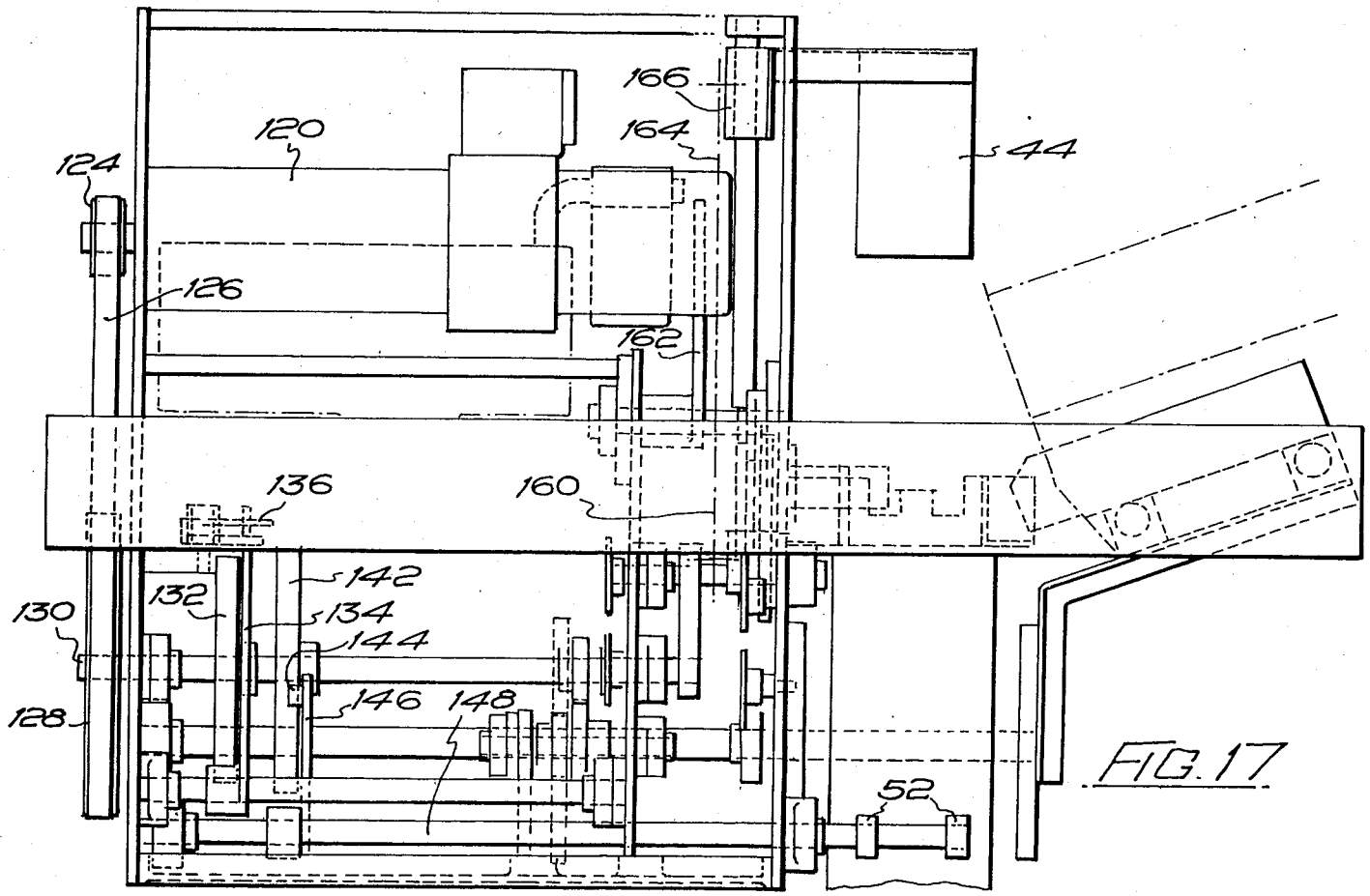
Figure 18:
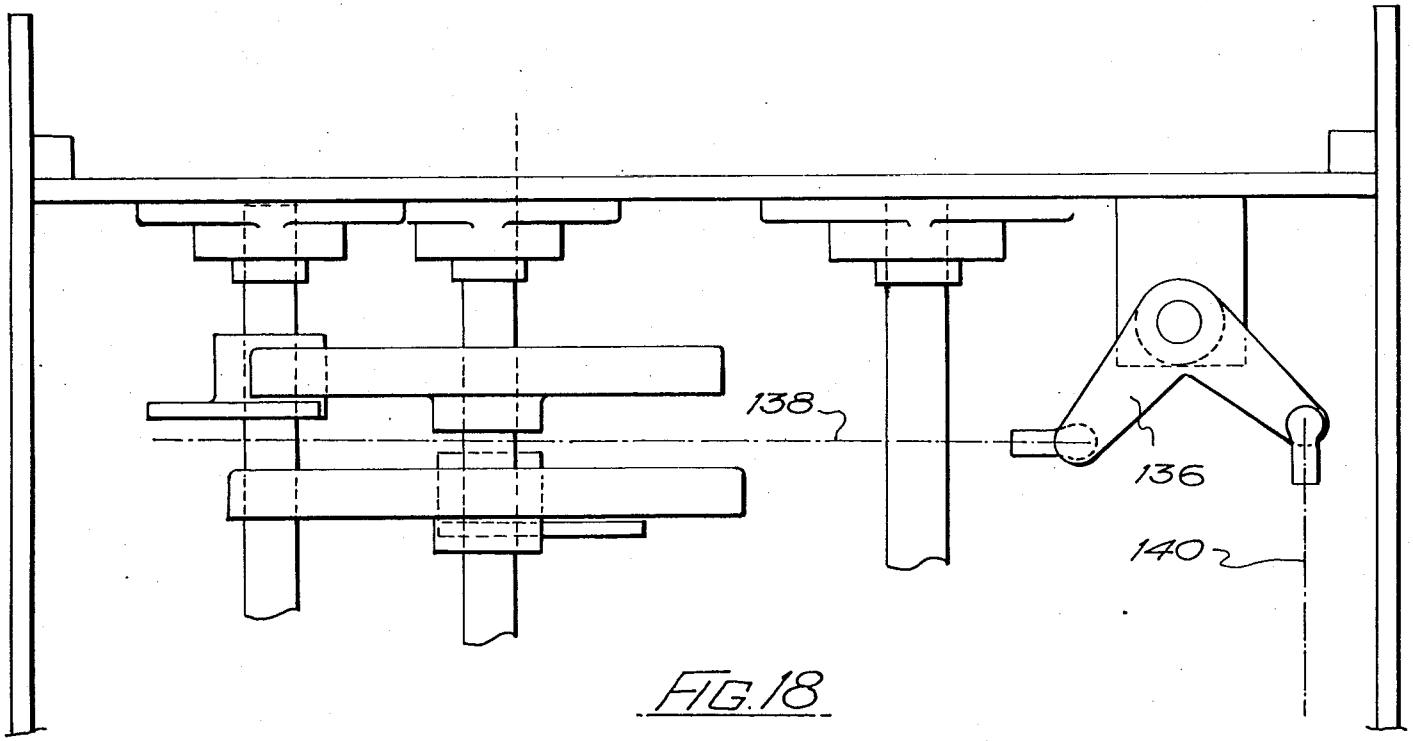

FIGS. 3*a*–3*c* are perspective views illustrating the sequence of operations in the holding and inserting tabs in the container packs;

FIG. 4 is a perspective view of a pack of containers with a tab inserted therein;

FIG. 5 is a side assembly view of the machine for performing the operation shown in FIG. 3;

FIG. 6 is a front elevation of the machine shown in FIG. 5;

FIG. 7 is a detailed side view showing the magazine and extractor mechanisms;

FIGS. 8, 9 and 10 respectively show plan, side elevation and end elevation of the plough device which is used for folding the tab blank;

FIG. 11 is half sectional side elevation of the transporting drum;

FIG. 11A is an end view of the drum shown in FIG. 11;

FIG. 11B is a plan view of a detail of the arrangement shown in FIG. 11 and 11A;

FIG. 12 and FIG. 13 respectively are side views showing the cam track profile of the leading and trailing transfer plates of the transfer drum shown in FIG. 11;

FIGS. 14(*a*)–(*i*) and 15(*a*)–(*h*) and (*j*)–(*l*) are developed views showing how the transfer plates alter in position in relation to the insertion of the folded blank into the drum on the one hand, and the insertion of the folded blank into the pack from the transfer drum on the other hand;

FIG. 16 is a front view of the machine showing the various drive transmissions thereof;

FIG. 17 is a side view corresponding to FIG. 16; and FIG. 18 is part plan of the machine shown in FIG. 16.

Figure 1:
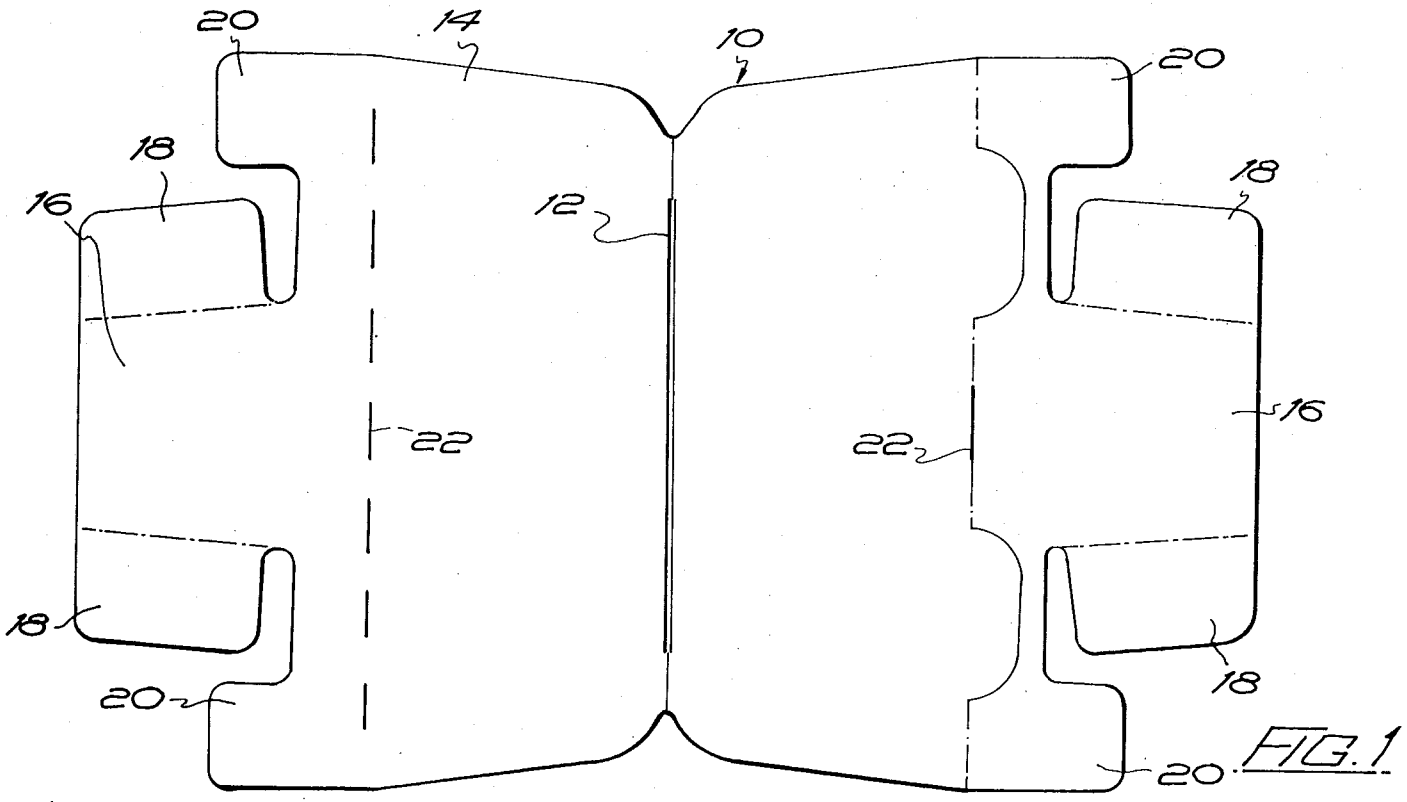
FIG. 1 is a plan view of a blank of a tab for insertion by a machine according to the invention.

Referring to the drawings, in FIG. 1 is shown a blank 10 of a tab which is for insertion in a container pack as will be explained hereinafter. The blank comprises a cut and creased sheet which is symmetrical about a central crease line 12, and each half 14 is essentially trapezium shaped with a tongue 16 at the long free edge thereof, the tongue 16 having fold over flaps 18, and and retaining projections or wings 20. The fold lines 22 enable the tab to be folded to a position where it lies flat on the container tops, but this invention is not concerned with the folding of the tab to this flat position.

Figure 2:
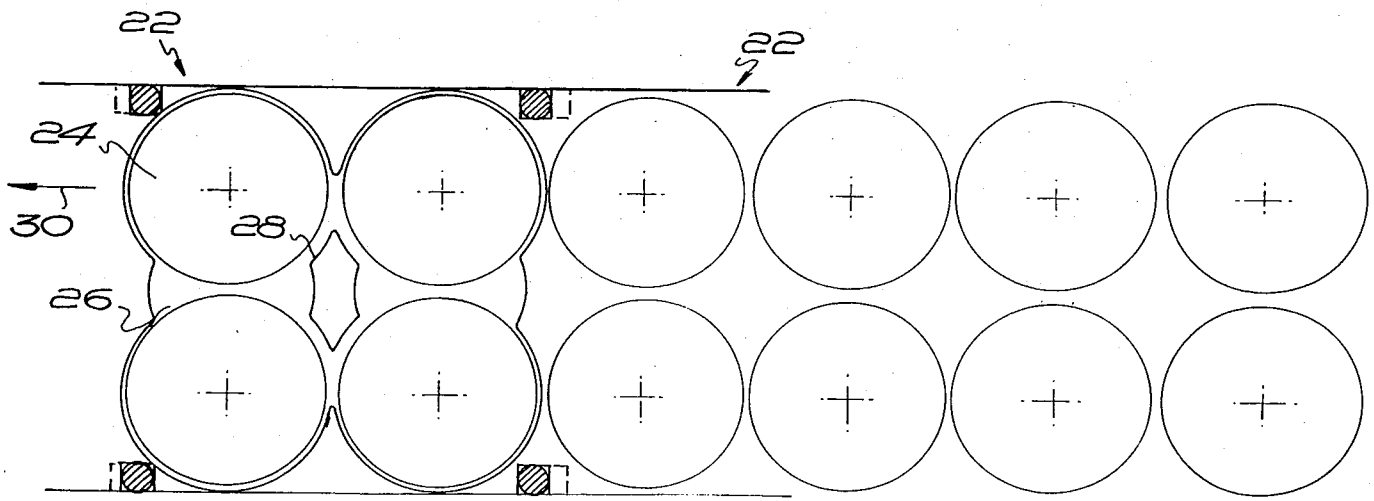
FIG. 2 is a plan view showing a queue of packs which travel to the machine and into the holding devices of which the folded tabs are to be inserted.

Referring now to FIG. 2, in this figure a queue of container packs 22 is shown, and each pack comprises four containers in the form of metal cans 24 which are held together by a plastic web holding device 26 of the "HICONE" type, each holding device 26 having a central somewhat diamond shaped structure 28. The queue of packs moves in the direction of arrow 30 and the tab devices are for insertion in the holes 28 by the insertion of the tongue 16 therein, and so that the flaps 18 engage under the holding device enabling the pack to be lifted by the tab. The assembled position is in fact shown in FIG. 4.

The machine according to the invention performs the folding of the tabs from the blank condition shown in FIG. 1 and the insertion of the tabs into the packs to achieve the position shown in FIG. 4, whilst the queue of packs moves in the direction of arrow 30 into and through the machine.

Referring to FIG. 3, this figure illustrates the sequence of operational steps in achieving the insertion of the tabs in the packs, and referring to FIG. 3, a blank 10 is shown in an elevated position in relation to the pack 22 at position A. The blank reaches this position when it is extracted from a magazine of the machine and placed in a position ready to receive the folding operation. In the first stage of folding operation, two rollers rotate in opposite directions, and they are provided with deflection wings which engage the flaps 18 on each side of the respective tongues 16 so that the flaps 16 move to the dotted line positions shown at A in FIG. 3. Next, a reciprocable blade engages the blank 10 along the centre line 12 and pushes it downwardly as indicated by arrow 32 through a gate and a plough device. This pushing of the blank via the centre line 12 causes the blank to fold in two as shown at station B in FIG. 3, and also causes the flap 18 to be folded face to face onto the tongues 16 as shown at station B in FIG. 3. The tab is held in this condition, and which is essentially flat, in a transporting drum which transports it as indicated by arrows 34 to the position at station C in which the tongues 16 and flaps 18 point downwardly and are moved into register with the aperture 28 in a holding device 26. In fact, the pack 22 continues moving in a horizontal direction as indicated by arrow 30, and the ends of the tongues and folded flaps start to enter the aperture 28 before the pack is directly underneath the axis of the transporting drum. When the pack 22 is directly under the axis of the transporting drum, insertion means acts to push the folded tab 10 out of the transporting drum and downwardly as indicated by arrow 36 into the aperture 28 until the flaps 18 are free to spring outwardly and locate under the holding device whereby the position shown in FIG. 4 is reached and in which the packs 22 can be lifted by the tab 10. The tab 10 is provided as a handle and may carry advertising material.

The machinery for performing the above sequence of operations will now be described in somewhat more detail.

FIGS. 5 and 6 are assembly views of the machine, and in FIG. 6 a horizontal surface 40 on which the packs 22 travel is shown, the direction of travel of the pack again being indicated by the arrow 30. The packs travel past a rotary transporting drum assembly 42 which receives the folded tabs as described with reference to FIG. 3, and the insertion blades for folding the tabs about a centre line 12 is indicated by numeral 44, such reciprocation direction being indicated by arrow 46. The rollers which form the pre-breaking of the flaps 16 are indicated by reference numerals 48 and 50. These rollers rotate in synchronism but in opposite directions, whilst the insertion device for inserting the folded tabs into the packs 22 is indicated as being a pair of pivot levers 52 pivotable about axis 54.

The magazine for receiving the flat blanks is indicated by reference 46, and as shown in FIG. 5 the magazine includes a weighted member 58 which presses on a stack 16 of the blanks 10.

FIGS. 5 and 6 also show that the machine stands on height-adjustable feet 62, and the base 64 has rollers 66 for the ease of moving of the machine from place to place. Height adjustment of the machine by virtue of the feet 62 is to enable the location of the surface 40 for different height packs to be accurately positioned in relation to the insertion means.

The packs 22 in fact travel in the direction of arrow 30 at a speed faster than the peripheral speed of drum 42, but the drum is provided with stop fingers 68 fixed appropriately to space the packs 22. As each pack 22 arrives at the location of the drum 42 it engages in pins or fingers 68 and its advance is retarded so that in fact the conveyor 40 slips relative to the under surface of the packs. This is to ensure that the packs are held in the correct position for the insertion of the tabs as shown in FIG. 3.

The machine is provided with several sensing devices namely an outlet sensing device 70 which senses if the packs 22 are not moving away freely from the machine after the tabs have been applied, and if so will stop the machine, whilst the inlet sensing devices 72 serve to stop the machine if packs 22 are not arriving at the machine correctly, which occurs if there should be two packs 22 between the lowermost point of the drum and the sensing device 72, as shown in FIG. 6.

Referring now to FIG. 7, the magazine and an extracting mechanism are shown in greater detail. The individual blanks 10 are removed from the stack 60 in the magazine by means of a pair of suction arms 74 which are pivotable about the axis 76, and carry suction cups 78. The vacuum is applied to the suction cups via a suction valve 80, and the valve 80 is operated by a cam on the axis 76 and a follower 82 which engages the cam and is carried on a pivotable switch arm 84. The arms 74 are swung in synchronism with the operation of the machine via a crank arm 86 which is coupled to a connecting rod as will be described later, which reciprocates essentially horizontal in the FIG. 7 illustration. In operation therefore the crank arm 86 is swung through substantially 90°, which moves the suction pads 78 into contact with the front blank of the stack 60, and which also operates the suction valve 80 causing suction to be applied to the pads 78 in this position whereby in the retraction step, the said first blank will be transported by the suction pads 78 to a substantially horizontal position in which it rests on a gate 88.

Turning now to FIGS. 8, 9 and 10, the said gate 88 is shown in some detail in the Figures, and in FIG. 8 a blank 10 is shown in position over the gate. The gate has a slot 90 lying centrally thereof and the blank is positioned so that its central fold 12 is in register with the slot 90. The slot is defined in the central region by four plough devices 92 which ensure the folding of the flaps 18 to a position shown at station B in FIG. 8. FIG. 8 also shows in dotted lines the rollers 48 and 50 with their pre-breaking blades 48A and 40A which perform the three breaking step, as explained in relation to FIG. 3 at station A. In the next operation, a blade 44 (shown in FIGS. 16 and 17) moves downwardly engaging the blank along the crease line 12, and forces it through the slot 90, which forces the blank to fold in two, and the ploughs 92 force the pre-broken flaps 18 into flat face to face contact with the tongues 16 as shown in FIG. 3 at station B, and continued movement of the blank through and out of the gate by virtue of the blade 44 causes the folded blank to move into the transportation drum 94 as shown in FIG. 11, and in particular the blank is moved into a position between a pair of holding plates 96, 98 so that the folded blank will be held in the folded condition as it is transported by the drum, which rotates continuously as indicated by the arrow 100 in FIG. 11. As can be seen, the drum 11 has a plurality of pairs of leading and trailing plates 96, 98, and in fact has eight eqi-angularly pairs of said plates which are carried on pivot axes 96A and 98A which lie on a fixed pitch circle 102 defined by a pair of spaced support plates 104 and 106.

The axes 96A and 98A are defined by shafts which carry the blades 96 and 98, and said shafts extend beyond the plates 104 and 106 as shown in FIG. 11A, the shafts 96A extending beyond the plate 104 and the shafts 98A extending beyond the plate 106 so that a plurality of shaft ends are presented at the outside of the plate 104, whilst a plurality of shaft ends are presented to th outside of plate 106. To the shaft ends are connected crank arms 96B and 98B, the arms being of the form shown in FIG. 11B, and the ends of the arms are provided with follower rollers 96C and 98C which engage in cam tracks in leading and trailing cam plates 108 and 110. This means that by appropriately shaping the cam tracks, the plates 96 and 98 can be made to execute pivotal movements about their pivot axes 96A and 98A whilst the drum rotates about the drum rotational centre 112. The shape of the leading cam track 114 of cam plate 108 is shown in FIG. 12, whilst the shape of the cam track 116 of cam plate 110 is shown in FIG. 13. These Figs. also show various positions of the follower rollers 96C and 98C as they travel along the cam tracks 114 and 116 during each revolution of the drum 94.

The cam tracks 114 and 116 are shaped so that the respective holding plates 96 and 98 will execute pivotal movements for best reception of the folded tab. This construction enables a blade which reciprocates vertically and radially with respect to the drum 94 to insert folded tabs into position between holding plates 96 and 98 whilst the drum rotates continuously.

Figure 15:
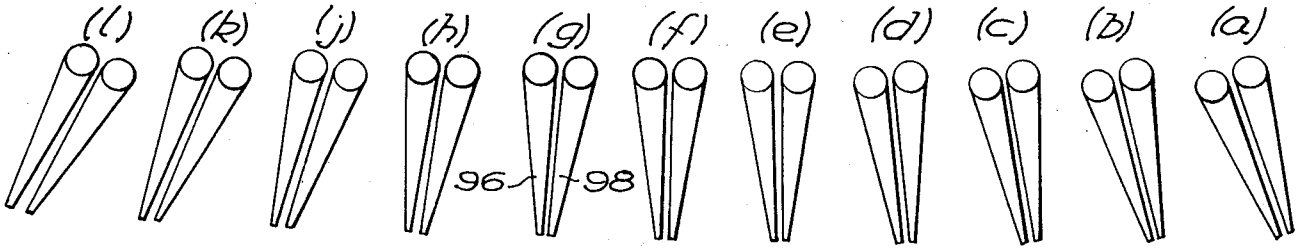

Reference is best made to FIGS. 14 and 15 to illustrate how the respective arms 96 and 98 of each pair are pivoted using the cam tracks 114 and 116 during the placement of a folded tab in the position between the arms and also the extraction of the folded tab from between the arms and for insertion into the container pack 32.

FIG. 15 shows in developed form the relative positions of the arms 96 and 98 of an arm pair as it approaches and passes the insertion blade. The relative positions (a) to (i) are indicated by the angular designations 300, 320, 340, 0, 20, 40, 60, 80 and 100, and these are the angular positions in the cycle of reciprocation of the blade as opposed to the drum. Dealing with the positions shown at FIG. 14(*a*) it will be seen that the arm 96 has been pivoted by its cam plate so as to be tilted forwardly slightly, whilst in the next position, when the blade has moved 320° in its cycle, the trailing arm 98 has been held to a rearwardly inclined position. The bottom position of the blade 44 is shown in position 14(*d*) when the arms 96 and 98 are in a splayed position in order to give the blade 44 room to retract during the next sequence of positions up to position 14(*h*), and in fact the two arms 96 and 98 are progressively tilted rearwardly to enable the blade to retract.

Similarly the positions shown in FIG. 15 illustrate that the cam tracks 114 and 116 keep the arms 96 and 98 as close together as possible up to the position 15(*f*) when the part 22 is directly under the axis 112 of location of the drum 94. At this point, the insertion arms 52 are pivoted about axis 54 and push the folded tab from between the arms into the aperture into the holding device in the position shown in FIG. 4. Through positions 15(*g*) to 15(*l*) the arms 96 and 98 are pivoted so as to lead a radial disposition, which enables the arms quickly to clear the tops of the cans of the pack of cam 22.

The various drives of the machine are shown in FIGS. 16 17 and 18, and referring to FIG. 17, the machine has a main drive motor 120 which is coupled via belt and pulley arrangement 124, 126, and 128 which drives a main cam shaft 130. This shaft 130 carries an extraction device cam 132 which is coupled, via a pivot arm 134 and a follower roller 136 engaging cam track in cam 132, to a belt crank lever 136 by means of a connecting rod 138, and another connecting rod 140 connects with the lever 86 (illustrated in FIG. 7) so that drive is transmitted from the motor 120 to the lever 86 to effect the movement of the extraction mechanism described hereinbefore.

The main cam shaft 130 also carries another cam 142 which, via a follower roller 144, engages in a cam track in the cam 142 and a pivot arm 146 oscillates an inserter shaft 148 which carries the inserter levers 52.

For the driving of the pre-break rollers 48 and 50, as shown in FIG. 16, the main cam shaft 130 drives an auxiliary shaft 150 via a belt 152, and wheel 152 is geared directly to wheel 50. A second belt 154 driven by wheel 150 passes round an idler roller 156 and eventually round the rollr 48.

The reciprocation of the blade 144 is achieved by the mounting of a lever 158 on the main cam shaft, and the lever is pivoted by means of a connecting roller 160 to another lever 162, and that lever in turn is connected by a connecting rod 164 to a slide block 166 which carries the blade 44.

It can be seen therefore that a single motor performs all of the driving operations of machine, and the machine is continuously driven, unless there are fault reasons why the machine is automatically stopped, for example it may be stopped by the sensors 17 and 22, and all of the parts of the machine are movable continuously. By virtue of the machine design it is achieved that folded tabs can be inserted by a linearly reciprocating blade into pockets which are moving continuously in a rotary fashion.

We claim:

1. A machine for inserting a tab in an assembly of containers held together by a holding device which has at least one aperture comprising:

(a) means for folding in two a cut and creased blank which forms the tab;

(b) means for folding flaps of the blank onto tongues of the blank;

(c) means for inserting the tongues and folded flaps of the blank into said aperture or apertures in the holding device so that the flaps will spring outwardly and engage under the holding device connecting the tab to the assembly;

(d) means for effecting the above operations on a repeating basis so that tabs are sequentially erected and inserted in respective assemblies which travel as a queue relative to the means for inserting; and (e) means for transporting the blank after the folding steps (a) and (b) from a receiving station of the means for transporting to the inserting means, wherein said means for transporting comprises a rotatable drum having angularly arranged holders for respective blanks, said holders each comprising a pair of radially arranged plates.

2. A machine according to claim 1 wherein of each pair of plates, one is a leading plate and one is a trailing plate, and the machine includes cam means controlling the relative angular positions of the leading and trailing plates of each pair during the respective positioning of the folded blanks between the plate pairs by means of a reciprocable knife which comprises said means for folding the blank in two and which reciprocates radially with respect of said drum.

3. A machine according to claim 2, wherein said holder plates means also serve to position the blank appropriately for insertion in the aperture or apertures of said holding device in that the machine includes conveyor means on which the assemblies travel tangentially relative to the drum and the blanks are progressively so inserted up to the point where the assembly lies radially of the drum.

4. A machine according to claim 2, wherein said cam means comprise respectively leading and trailing cam plates located at opposite ends of the drum, and each leading plate is on a shaft pivotally mounted on a drum plate of a fixed radius and has a crank carrying a follower roller which engages in and follows a cam track in the leading cam plate, and each trailing plate is on a shaft pivotally mounted on said drum plates at said fixed radius, and has a crank carrying a follower roller which engages in and follows a cam track on the trailing cam plate.

5. A machine according to claim 3, wherein said cam means comprise respectively leading and trailing cam plates located at opposite ends of the drum, and each leading plate is on a shaft pivotally mounted on a drum plate of a fixed radius and has a crank carrying a follower roller which engages in and follows a cam track in the leading cam plate, and each trailing plate is on a shaft pivotally mounted on said drum plates at said fixed radius, and has a crank carrying a follower roller which engages in and follows a cam track on the trailing cam plate.

6. A machine according to claim 1, wherein said means for folding flaps comprises two rotatable rollers having folding wings which initially fold two flaps on two tongues out of the plane of the blank, and two fixed plough devices which complete the folding of the flaps onto said tongues as the blank is folded by said means for folding the blank in two.

7. A machine according to claim 2, wherein said means for folding flaps comprises two rotatable rollers having folding wings which initially fold two flaps on two tongues out of the plane of the blank, and two fixed plough devices which complete the folding of the flaps onto said tongues as the blank is folded by said means for folding the blank in two.

8. A machine according to claim 3, wherein said means for folding flaps comprises two rotatable rollers having folding wings which initially fold two flaps on two tongues out of the plane on the blank, and two fixed plough devices which complete the folding of the flaps onto said tongues as the blank is folded by said means for folding the blank in two.

9. A machine according to claim 4, wherein said means for folding flaps comprises two rotatable rollers having folding wings which initially fold two flaps on two tongues out of the plane of the blank, and two fixed plough devices which complete the folding of the flaps onto said tongues as the blank is folded by said means for folding the blank in two.

10. A machine according to claim 1, wherein said means for insertion comprises reciprocable lever arms which re reciprocated in synchronism with the operation of the machine to push the folded blanks in a direction at right angles to the queue of assemblies.

11. A machine according to claim 3, wherein said means for insertion comprises reciprocable lever arms which are reciprocated in synchronism with the operation of the machine to push the folded blanks in a direction at right angles to the queue of assemblies.

12. A machine according to claim 14, wherein said means for insertion comprises reciprocable lever arms which are reciprocated in synchronism with the operation of the machine to push the folded blanks in a direction at right angles to the queue of assemblies.

13. A machine according to claim 1, comprising a magazine for receiving a plurality of flat blanks, and including extraction means for extracting the blanks one by one in synchronism with the operation of the machine to place the blanks individually in operative position for engagement by the means for folding the blanks in two.

14. A machine according to claim 3, comprising a magazine for receiving a plurality of flat blanks, and including extraction means for extracting the blanks one by one in synchronism with the operation of the machine to place the blanks individually in operative position for engagement by the means for folding the blanks in two.

15. A machine according to claim 4, comprising a magazine for receiving a plurality of flat blanks, and including extraction means for extracting the blanks one by one in synchronism with the operation of the machine to place the blanks individually in operative position for engagement by the means for folding the blanks in two.

16. A machine according to claim 1, which stands on height adjustable feet so that the height of the insertion means can be adjusted to suit the height of the queue of assemblies.

17. A machine according to claim 3, which stands on adjustable fet so that the height of the insertion means can be adjusted to suit the height of the queue of assemblies.

18. A machine according to claim 4, which stands on adjustable feet so that the height of the insertion means can be adjusted to suit the height of the queue of assemblies.

* * * * *